United States Patent [19]

Hukki

[11] Patent Number: 5,051,171

[45] Date of Patent: Sep. 24, 1991

[54] SELF-CLEANING SYSTEM FOR VIBRATORY SCREENS

[75] Inventor: Ari M. Hukki, Edgewood, Ky.

[73] Assignee: Sweco Incorporated, Florence, Ky.

[21] Appl. No.: 515,471

[22] Filed: Apr. 27, 1990

[51] Int. Cl.[5] ..... B07B 1/50

[52] U.S. Cl. ..... 209/323; 209/385

[58] Field of Search ..... 209/323, 379, 381, 382, 209/385, 387, 367, 379, 389, 320, 324

[56] References Cited

U.S. PATENT DOCUMENTS

| | | | |
|---|---|---|---|
| 546,241 | 9/1895 | McAnulty | 204/379 X |
| 568,915 | 10/1896 | Mitchell | 209/326 |
| 2,455,383 | 12/1948 | Pickard | 209/323 |
| 2,862,620 | 12/1958 | Van Zelst, Jr. | 209/381 X |
| 3,191,774 | 6/1965 | Schrader | 209/379 X |
| 3,960,731 | 6/1976 | Brandt | 209/323 X |
| 4,526,682 | 7/1985 | Wallace | 209/381 X |

FOREIGN PATENT DOCUMENTS

| | | | |
|---|---|---|---|
| 483069 | 5/1917 | France | 209/320 |
| 698903 | 10/1953 | United Kingdom | 209/381 |

*Primary Examiner*—Donald T. Hajec

*Attorney, Agent, or Firm*—Lyon & Lyon

[57] ABSTRACT

A system for providing a self-cleaning function to rectangular vibratory screens which may be disposed on an incline in a vibratory separating system. Pans or screens defining flow-through support surfaces span across the frame of a screen parallel and displaced from the screen cloth. Sliders are positioned on the pans which have the capability of impacting the underside of the screen cloth when the vibratory system is in motion. Dynamic mechanisms for imparting circulatory motion to the sliders include mounting rods associated with the pans or screen frame members which extend laterally across same. Tubes capable of eccentric motion about the rods are mounted thereto such that the vibratory motion of the screening mechanism induces such movement for impacting against sliders to cause slider circulation. The sides of the pans are slightly flared outwardly to engage the screen frame for proper location of the system within each screen.

36 Claims, 4 Drawing Sheets

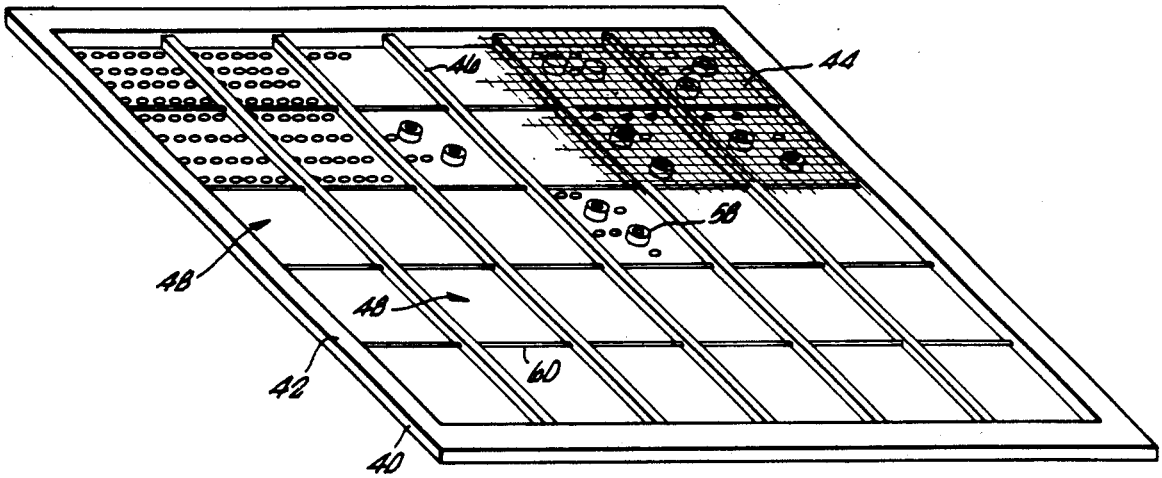
FIG. 2.
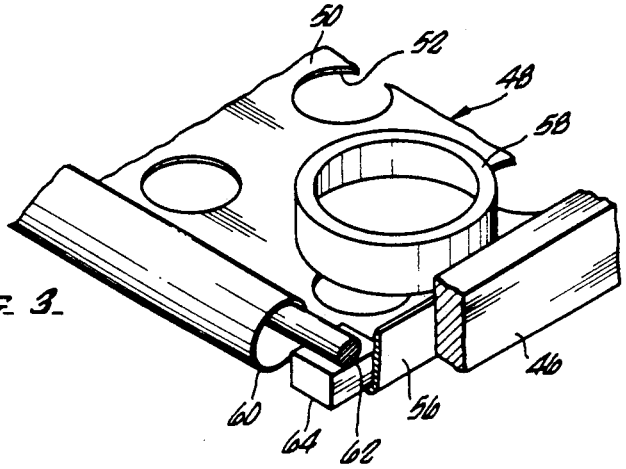
FIG. 3.
FIG. 4.
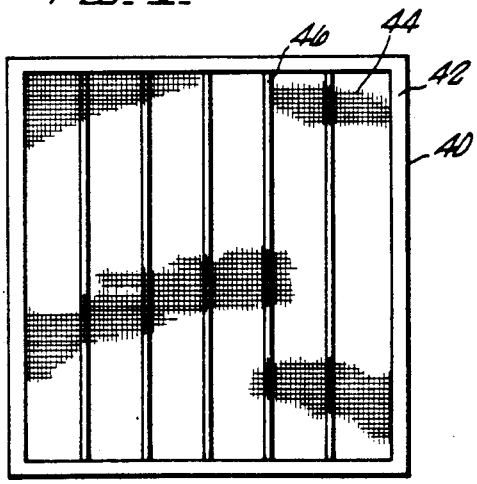
FIG. 5.
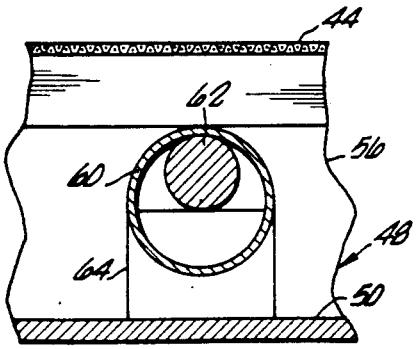

SELF-CLEANING SYSTEM FOR VIBRATORY SCREENS

BACKGROUND OF THE INVENTION

The field of the present invention is vibratory screening devices and self-cleaning systems therefor.

Vibratory screen separators are well known. Tensioned metal screen cloth is normally used in such devices. Such separators typically employ either rectangular or circular screens which are driven by rotating eccentric weights or other vibration inducing mechanisms. The vibration assists in the passage of material through the screen and in prolonging the effectiveness of the screen. However, blinding of the screen cloth remains a frequent problem.

To substantially prolong the effectiveness of a screen by reducing blinding, self-cleaning systems have been developed. In circular vibratory screening devices, screen assemblies have included self-cleaning systems having a flow-through support surface spanning across the screen frame and located below and substantially parallel to the screen cloth. Such flow-through support surfaces have been defined by perforated metal plates, screens and the like. Normally the support includes openings which are larger than the openings in the overlaying screen cloth. However, other arrangements may be employed in specific circumstances. Sliders are positioned in the space between the support surface and the screen cloth. These sliders are frequently cylindrical in cross section. They are induced by the vibration of the screening mechanism to move about such a circular screening device and impact against the screen cloth under the influence of the vibratory motion of the separator. This repeated impact of the sliders acts to free the screen cloth of material such that it eventually will pass through the screen or be separated off.

With rectangular vibratory screen separator devices, sliders and other self-cleaning elements have not proven as effective. In rectangular systems, either the vibratory motion or screen orientation or both frequently act to concentrate the sliders at one end or corner of the screen. For example, rectangular screens are often placed on an angle; and under such circumstances, the sliders have a tendency to collect at the lower end of the frame. Even with rectangular, level screens, the sliders do not migrate about the screen as well as with a circular screen. Sliders may even migrate uphill under certain vibratory conditions.

Systems have been developed to cause impacting against the screen cloth in rectangular systems. A support surface is used with resilient balls positioned between the screen cloth and the support surface. Angled surfaces are also included as part of the support surface which direct the bouncing balls against the screen cloth. Rectangular screens are frequently operated at an incline and the balls continually return to the angled surface located at the lower end of the frame to be redirected toward the screen cloth.

SUMMARY OF THE INVENTION

The present invention is directed to a screen self-cleaning system which employs a support surface below a screen, elements such as sliders or balls between the support surface and the screen, and a dynamic system for imparting energy to the cleaning elements to cause them to be disbursed about the screen area in a vibratory screening device. The dynamic system could be driven by the vibratory energy of the screening device and would, in that instance, include an eccentrically mounted weight.

In an additional aspect of the present invention, a rod is positioned adjacent a support surface and substantially parallel to the screen cloth to be cleaned. A tube having an inner diameter larger than the rod is rotatably mounted about the rod. Under the influence of system vibration, the tube rotates eccentrically about the rod. Cleaning elements positioned between the screen cloth and the support surface are impacted upon by the tube and caused to be disbursed about the underside of the screen cloth. The vibration of the vibratory screen separator also operates on the elements to cause them to impact against the underside of the screen cloth.

In another aspect of the present invention, a self-cleaning system is contemplated which includes a support surface that is positionable beneath the screen cloth. Rods held fixed relative to the support surface mount tubes for eccentric rotation. Cleaning elements are again contemplated. The support surface includes flanges extending laterally from the support surface which may also be mutually divergent. Such an arrangement allows them to be associated with the screen frame for positive positioning therewith.

Accordingly, it is an object of the present invention to provide an improved screen self-cleaning system for vibratory screen separating devices. Other and further objects and advantages will appear hereinafter.

BRIEF DESCRIPTION OF THE DRAWINGS

FIG. 2 is an oblique view of a screen having self-cleaning systems associated therewith.

FIG. 3 is a oblique detail view of a screen self-cleaning system.

FIG. 4 is a plan view of a screen with which self-cleaning systems may be employed.

FIG. 5 is a cross-sectional view taken along line 5—5 of FIG. 9.

DETAILED DESCRIPTION OF THE PREFERRED EMBODIMENT

Figure 1:
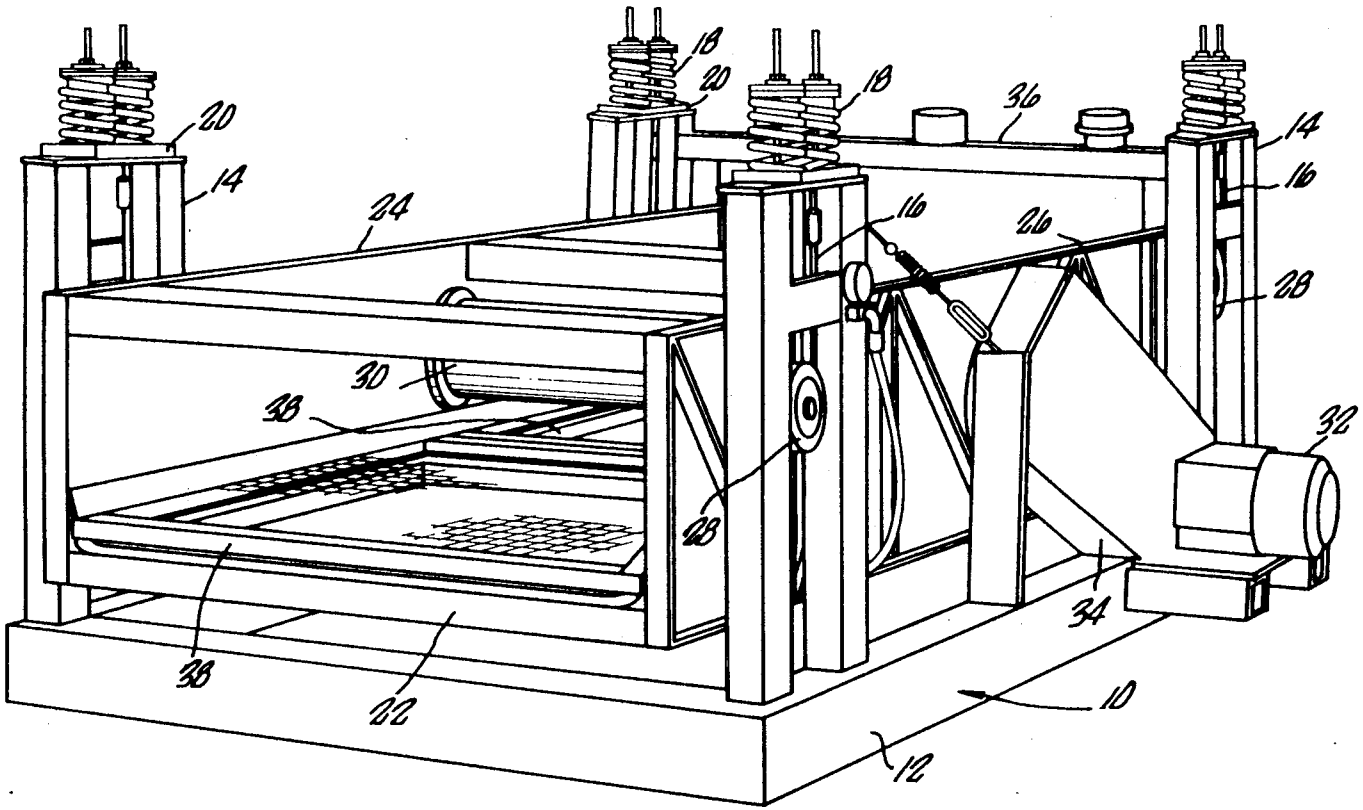
FIG. 1 is an oblique view of a rectangular screening system.

Turning in detail to the drawings, FIG. 1 illustrates a vibratory screening mechanism such as may be employed in association with the present invention for wet or dry separation. The separator includes a supporting structure, generally designated 10, which includes a rectangular base 12 with upstanding double columns 14 at each corner. Mounted on each double column 14 is a flexible support mechanism including a downwardly extending cable loop 16 attached at each end through a coil spring 18. The coil springs are mounted on cross members 20 extending between the double columns 14.

Positioned within the support structure 10 is a vibratory housing, generally designated 22. The housing 22 is rectangular in plan and has sidewalls 24 and 26. The entire vibratory housing 22 is mounted resiliently to the supporting structure 10 by wheels 28 positioned in the cable loops 16.

Associated with the vibratory housing 22 is a transverse tube 30 which encloses the rotary mounted vibratory weights which may be of conventional design. These weights are driven by a drive motor 32 fixed to the supporting structure 10, power being directed through a chain or belt located within a housing 34. A distributor 36 provides conditioned flow across the width of the vibratory housing 22 at one end, downwardly into the screen area.

The vibratory housing 22 does not have a bottom. Flow is directed through a plurality of rectangular frames 38. There are three rectangular frames in this embodiment which lie in a plane and are arranged side-by-side. These rectangular frames may be formed by four cross members, equally spaced across the housing 10 including one at each end. These rectangular frames 38 incorporate the sidewalls 2 and 26 running the length of the vibratory housing 22 on each side. As a result, three rectangular supports of equal plan are defined with open areas centrally through each support for material flow.

The foregoing screening system is but one possible configuration which may be employed with the present invention. Such systems are well known. The plane of the screens may be set at a range of angles to the horizontal, typically from 0° to 40°.

FIG. 4 illustrates a screen 40 which may be employed with the rectangular frames 38. The screen 40 has a rectangular frame 42 and tensioned screen cloth 44. Internal ribs 46 run in one direction parallel to two sides of the frame 42.

Figure 10:
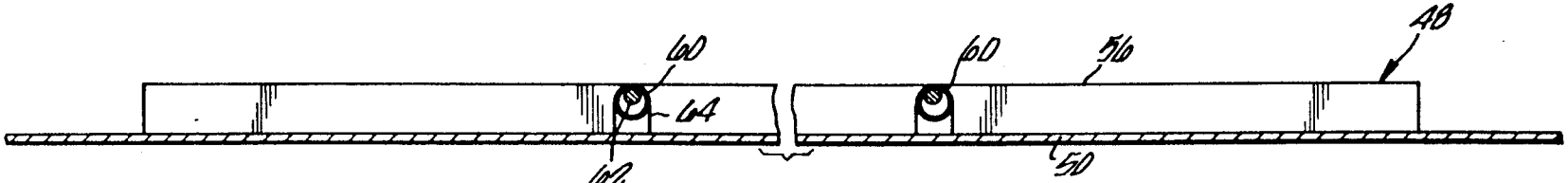
FIG. 10 is a cross-sectional side view taken along line 10—10 of FIG. 6.
Figure 6:
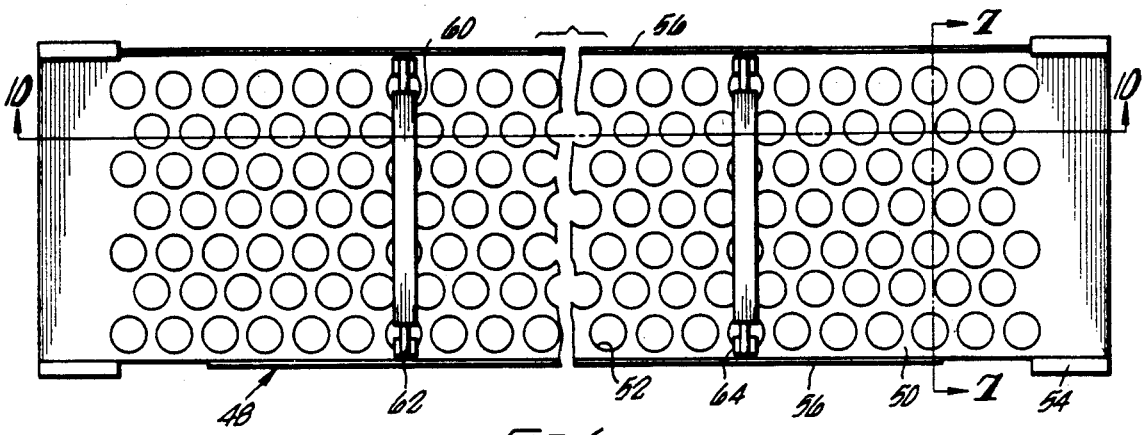
FIG. 6 is a plan view of a self-cleaning system.
Figure 7:
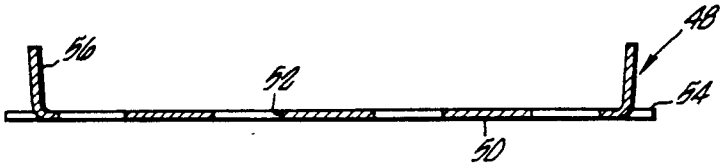
FIG. 7 is a cross-sectional view taken along line 7—7 of FIG. 6.
Figure 8:
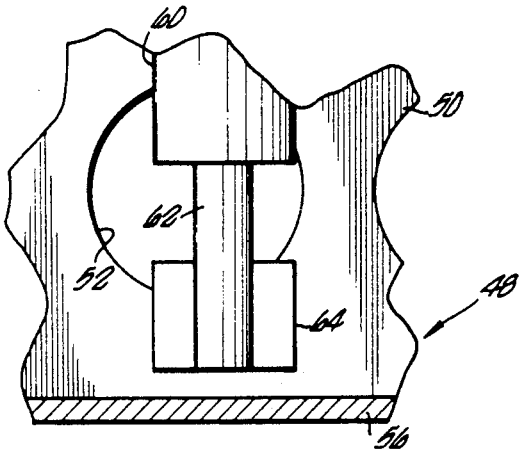
FIG. 8 is a plan detail view of the rod mounting as seen in FIG. 6.
Figure 9:
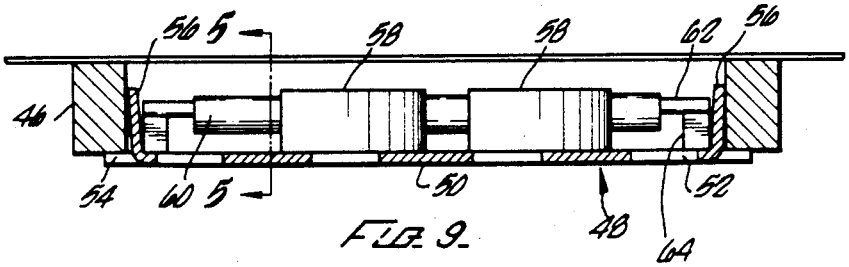
FIG. 9 is a cross-sectional end view of an assembled screen and self-cleaning system.

As generally disclosed in FIG. 2, self-cleaning systems may be assembled with a screen between the internal ribs 46. Each system includes a pan, generally designated 48. The pan 48 is best illustrated in FIGS. 6, 7 and 10. Each pan 48 is of sufficient width to be placed in interference fit between internal ribs 46, or an internal rib 46 and one side of the rectangular frame 42, in a screen 40. The pan 48 also extends longitudinally to cover the full length of the screen between sides of the frame. With the screen of FIG. 4, six such pans 48 would be employed to provide a complete self-cleaning screen assembly.

The pan 48 includes a plate 50 having holes 52 therethrough. This plate 50 thus forms a flow through support surface which spans across the frame 38. Tabs 54 extend outwardly from the plate 50 at the corners of the pan 48 for location beneath the frame 42 and internal ribs 46. Extending substantially laterally from the plate 50 are side flanges 56. These side flanges are slightly mutually divergent such that the placement of a pan 48 between internal ribs 46 provides an interference but resilient fit. The material of the pan 48 is selected to be resistant to chemical or physical attack by the material being screened. Typically the plate 50 of the pan 48 must be able to withstand without substantial flexure a maximum amplitude of 0.25 inches and 7 G-force accelerations. The holes 52 are normally to be larger than the holes in the screen cloth 44. Applications where the reverse is true are also known.

The tabs 54 and the side flanges 56 have the capability of locating each pan 48 within the screen frame 42. However, under vibratory conditions, it is additionally preferred, if not necessary, to securely locate each pan 48 through additional attachment mechanisms. Bonding, bolting and clamping are satisfactory to this task. In the preferred embodiment, the holes 52 through the plate 50 are larger than the holes in the screen cloth 44, as mentioned above. Under this condition, no sealing about the pan 48 is necessary. Under the circumstance that the pan 48 also acts as a screening mechanism because the holes 52 are smaller than the holes in the screen cloth 44, appropriate sealing would be suggested.

To provide the self-cleaning function to the screen assembly, cleaning elements 58 are positioned on the pans 48 beneath the screen cloth 44. The cleaning elements 58 are conveniently sliders having a cylindrical shape to stably orient on the pan 48. Other cleaning elements are contemplated such as resilient balls. The height of the sliders 58 is such that there is clearance between the bottom of the screen cloth 44 and the top of the plate 50. This clearance allows the sliders 58 some room to bounce and tap the bottom of the screen. It is preferred that the slider height be in excess of one-half the distance between the plate 50 and the screen cloth 44. This prevents the possibility that sliders may become stacked one upon another. Additionally, the preferred minimum diameter of the sliders 58 is greater than the distance between the plate 50 and the screen cloth 44. This relationship prevents sliders from turning on edge. Sliders are also preferably small enough that they can pass one another in the confined area defined by the pan 48 for circulation purposes. The material and wall thickness of the sliders should be such that they resist wear, are not chemically attacked by the material being screened, are substantially rigid and yet are relatively light. Plastics have proven useful in this environment. Finally, the sliders operate best when they each have a diameter which is at least 50% greater than the holes 52 in the plate 50. If the sliders are relatively smaller than that, they may tip into the hole and come to rest on their edge.

Associated with the pans 48 are dynamic systems for using the vibratory energy of the separator to impart energy to the cleaning elements. This imparted energy is designed to repeatedly disburse the elements 58 to all areas of the screen 40. These dynamic systems are generally arranged to divide each pan 48 into sections. Cleaning elements 58 are then retained within each section. Self-cleaning capability thus may be provided in each section to effectively cover the entire screen 40. Such an arrangement is best illustrated in FIG. 2.

Each dynamic system employs a member 60 extending across the pan 48. The member 60 moves eccentrically, conveniently through energy imparted from the vibratory motion of the screen system. This motion causes the member 60 to impact against the sliders 58 to insure circulation about the section or sections adjacent the member 60. When the screen 40 is at an incline, up to about 40°, the sliders 58 may tend to migrate to the lowest portion of the pan 48 within each section defined by the members 60. The eccentric motion of the members 60 and the migration of the sliders 58 result in collisions between the two, driving the sliders about the section. Under certain vibratory conditions, the sliders 58 will tend to migrate uphill. The members 60 will perform equally under this situation. The dynamic systems may also be specifically arranged to accommodate these situations. For example, a tube could be mounted adjacent to one end member of the frame. If the vibratory motion is such that the sliders move down the screen, this tube would be arranged at the lower end. If the sliders move up, the screen assembly could be rotated 180°.

In the instance where the eccentrically moving members 60 are driven by the vibratory motion of the separator, they will typically rotate with the same period of motion as the vibrating screen. The members 60 are preferably of sufficient mass such that they can maintain this rotation even while intermittently losing energy to the cleaning elements through repeated impacts therewith.

A variety of mechanisms may be employed to mount the eccentrically moving members 60. For example, solid rods mounted about axes of rotation displaced from the center of mass may be employed. In the preferred embodiment, however, tubes 60 are loosely positioned about stationary rods 62. The tubes are preferably metallic to provide sufficient mass for continued rotation with impacts against the relatively light sliders. The tubes 60 extend across a greater part of the width of an associated pan 48. It is not essential that the tubes 60 extend fully across the pans 48. However, it is preferred that the extension is sufficient such that cleaning elements 58 which land adjacent the sides of the pan 48 will also be contacted by a tube such that energy will be imparted to the cleaning element 58 to cause it to circulate within the section.

Each dynamic system is mounted by means of blocks 64 located to either side of the pan 48 and welded or otherwise attached thereto. Extending between the blocks 64 are the stationary rods 62. The tubes 60 are in turn mounted about the stationary rods 62 inwardly of the blocks 64. The materials and strengths of these elements must be sufficient to withstand the 7 G acceleration forces common to such vibratory systems. The location of each stationary rod 62 within the pan 48 is preferably with the centerline thereof located at the midpoint between the support surface of the plate 50 and the underside of the screen cloth 44. Such a placement provides maximum eccentricity to the tube 60.

To allow eccentric motion, the inside diameter of the tube 60 must be greater than the outside diameter of the rod 62. It is preferred that the diameter of the rod 62 not exceed 75% of the inside diameter of the tube. This relationship allows the tube sufficient eccentricity to maintain movement and properly impact against sliders as well. The relationship of the tube cross section and the rod is preferably such that the full eccentric throw of the tube will not cause it to come into contact with either the plate 50 of the pan 48 or the screen cloth 44 of the screen 40.

Figure 11:
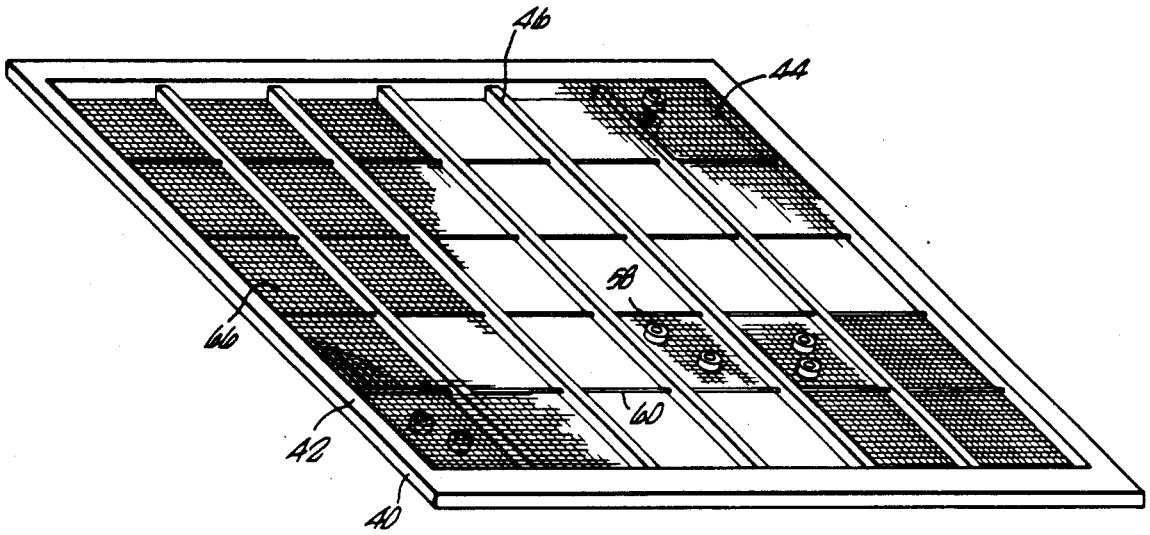
FIG. 11 is an oblique view of a screen having a second embodiment screen self-cleaning system.
Figure 12:
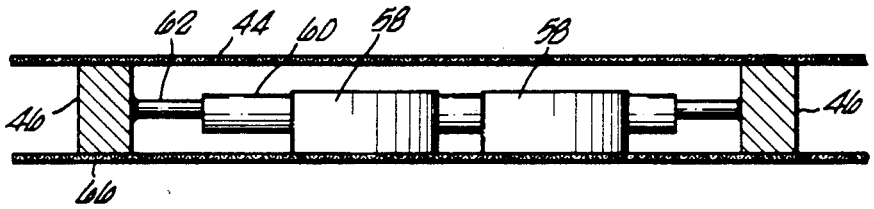
FIG. 12 is a cross-sectional end view of an assembled screen and self-cleaning system of FIG. 11.

FIGS. 11 and 12 illustrate a second embodiment. Similar reference characters between the two embodiments denote similar elements. In this second embodiment, the lower, flow through support surface is a screen cloth 66 bonded or otherwise held to the screen frame 42. The rods 62 are directly welded or otherwise attached to the outer frame members 42 or to the internal ribs 46. Cleaning elements 58 such as sliders or balls are positioned between the screen cloths 44 and 66.

Thus, a system employed with rectangular screens is presented which provides what has come to be known as a self-cleaning function. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A self-cleaning screen assembly for a vibratory screen separator, comprising a frame;

a flow through support surface scanning across said frame, said flow through support surface including a plate with holes therethrough and flanges extending substantially normally from said plate on opposite sides thereof, said flanges being slightly mutually divergent and spaced to fit in interference within said frame;

screen cloth extending across said frame substantially parallel to and displaced from said support surface;

cleaning elements positioned between said support surface and said screen cloth;

a mounting between said support surface and said screen cloth defining a horizontal mounting axis;

a member mounted eccentrically about said mounting axis of said mounting between and displaced from both said support surface and said screen cloth to move eccentrically in response to vibration of said frame.

2. The self-cleaning screen assembly of claim 1 further comprising a plurality of said mountings and a plurality of said members associated with said mountings, respectively, said mountings being mutually spaced apart.

3. The self-cleaning screen assembly of claim 1 wherein said flow through support surface includes a screen.

4. The self-cleaning screen assembly of claim 1 wherein said cleaning elements are sliders.

5. A self-cleaning screen assembly for a vibratory screen separator, comprising a frame;

a flow through support surface spanning across said frame;

screen cloth extending across said frame substantially parallel to and displaced from said support surface;

cleaning elements positioned between said support surface and said screen cloth;

a mounting between said support surface and said screen cloth defining a mounting axis, said mounting including a stationary rod defining said axis between and extending substantially parallel to said support surface and said screen cloth;

a member mounted eccentrically about said mounting axis of said mounting between and displaced from both said support surface and said screen cloth to move eccentrically in response to vibration of said frame, said member including a tube mounted on said stationary rod, the inside diameter of said tube being larger than the diameter of said stationary rod and said stationary rod being displaced from said support surface such that said tube is free to eccentrically rotate about said rod without contacting said support surface.

6. The self-cleaning screen assembly of claim 5 further comprising a plurality of said mountings and a plurality of said members associated with said mountings, respectively, said mountings being mutually spaced apart.

7. The self-cleaning screen assembly of claim 5 wherein said flow through support surface includes a plate with holes therethrough and flanges extending substantially normally from said plate on opposite sides thereof, said flanges being slightly mutually divergent and spaced to fit in interference within said frame.

8. The self-cleaning screen assembly of claim 5 wherein said flow through support surface includes a screen.

9. The self-cleaning screen assembly of claim 5 wherein said cleaning elements are sliders.

10. A self-cleaning screen assembly for a vibratory screen separator, comprising a frame;

a flow through support surface spanning across said frame, said flow through support surface includes a plate with holes therethrough and flanges extending substantially normally from said plate on opposite sides thereof, said flanges being slightly mutually divergent and spaced to fit in interference within said frame;

screen cloth extending across said frame substantially parallel to and displaced from said plate;

cleaning elements positioned between said plate and said screen cloth;

a plurality of mountings between said plate and said screen cloth, said mountings being mutually spaced apart, each said mounting including a stationary rod defining an axis between and extending substantially parallel to said plate and said screen cloth;

a plurality of members mounted eccentrically about said stationary rods, respectively, between and displaced from both said plate and said screen cloth to move eccentrically in response to vibration of said frame, each said member including a tube mounted on a said stationary rod, respectively, the inside diameter of each said tube being larger than the diameter of the associated said stationary rod and each said stationary rod being displaced from said plate such that the associated said tube is free to eccentrically rotate about said rod without contacting said plate.

11. The self-cleaning screen assembly of claim 10 wherein said cleaning elements are sliders.

12. A self-cleaning system for screens used in a vibratory screen separator, comprising a flow through support surface;

cleaning elements positionable on said support surface;

a mounting fixed to said support surface and defining a mounting axis displaced from and substantially parallel to said support surface;

a member mounted eccentrically about said mounting axis of said mounting and displaced from said support surface to move eccentrically in response to vibration of the vibratory screen separator.

13. The self-cleaning system of claim 12 further comprising a plurality of said mountings and a plurality of said members associated with said mountings, respectively, said mountings being mutually spaced apart.

14. The self-cleaning system of claim 13 wherein said flow through support surface includes a screen.

15. The self-cleaning system of claim 13 wherein said cleaning elements are sliders.

16. A self-cleaning system for screens used in a vibratory screen separator, comprising a flow through support surface, said flow through support surface including a plate with holes therethrough and flanges extending substantially normally from said plate on opposite sides thereof, said flanges being slightly mutually divergent and spaced to fit in interference within the screen;

cleaning elements positionable on said plate;

a mounting fixed to said support surface and defining a mounting axis displaced from and substantially parallel to said plate;

a member mounted eccentrically about said mounting axis of said mounting and displaced from said plate to move eccentrically in response to vibration of the vibratory screen separator.

17. The self-cleaning system of claim 16 wherein said cleaning elements are sliders.

18. A self-cleaning system for screens used in a vibratory screen separator, comprising a flow through support surface;

cleaning elements positionable on said support surface;

a mounting fixed to said support surface and defining a mounting axis displaced from and substantially parallel to said support surface, said mounting including a stationary rod defining said axis;

a member mounted eccentrically about said mounting axis of said mounting and displaced from said support surface to move eccentrically in response to vibration of the vibratory screen separator, said member including a tube mounted on said stationary rod, the inside diameter of said tube being larger than the diameter of said stationary rod and said stationary rod being displaced from said support surface such that said tube is free to eccentrically rotate about said rod without contacting said support surface.

19. The self-cleaning system of claim 18 wherein said flow through support surface includes a screen.

20. The self-cleaning system of claim 18 wherein said cleaning elements are sliders.

21. A self-cleaning system for screens used in a vibratory screen separator, comprising a flow through support surface, said flow through support surface including a plate with holes therethrough and flanges extending substantially normally from said plate on opposite sides thereof, said flanges being slightly mutually divergent and spaced to fit in interference within the screen;

sliders positionable on said plate;

a mounting fixed to said support surface and defining a mounting axis displaced from and substantially parallel to said plate, said mounting including a stationary rod defining said axis;

a member mounted eccentrically about said mounting axis of said mounting and displaced from said plate to move eccentrically in response to vibration of the vibratory screen separator, said member including a tube mounted on said stationary rod, the inside diameter of said tube being larger than the diameter of said stationary rod and said stationary rod being displaced from said support surface such that said tube is free to eccentrically rotate about said rod without contacting said support surface.

22. The self-cleaning system of claim 21 further comprising a plurality of said mountings and a plurality of said members associated with said mountings, respectively, said mountings being mutually spaced apart.

23. A self-cleaning screen assembly for a vibratory screen separator, comprising a frame;

a flow through support surface spanning across said frame;

cleaning elements positioned on said support surface;

a mounting fixed relative to said support surface defining a mounting axis extending substantially parallel to said support surface;

a member mounted eccentrically about said mounting axis of said mounting displaced from said support surface to move eccentrically in response to vibration of said frame.

24. The self-cleaning screen assembly of claim 23 further comprising a plurality of said mountings and a plurality of said members associated with said mountings, respectively, said mountings being mutually spaced apart.

25. The self-cleaning screen assembly of claim 23 wherein said flow through support surface includes a plate with holes therethrough and flanges extending substantially normally from said plate on opposite sides thereof, said flanges being slightly mutually divergent and spaced to fit in interference within said frame.

26. The self-cleaning screen assembly of claim 23 wherein said flow through support surface includes a screen.

27. The self-cleaning screen assembly of claim 23 wherein said cleaning elements are sliders.

28. A self-cleaning screen assembly for a vibratory screen separator, comprising a frame;

a flow through support surface spanning across said frame;

cleaning elements positioned on said support surface;

a mounting fixed relative to said support surface defining a mounting axis extending substantially parallel to said support surface;

a member mounted eccentrically about said mounting axis of said mounting displaced from said support surface to move eccentrically in response to vibration of said frame, said member being substantially heavier than each said cleaning element.

29. The self-cleaning screen assembly of claim 28 further comprising a plurality of said mountings and a plurality of said members associated with said mountings, respectively, said mountings being mutually spaced apart.

30. The self-cleaning screen assembly of claim 28, wherein said flow through support surface includes a plate with holes therethrough and flanges extending substantially normally from said plate on opposite sides thereof, said flanges being slightly mutually divergent and spaced to fit in interference within said frame.

31. The self-cleaning screen assembly of claim 28 wherein said flow through support surface includes a screen.

32. The self-cleaning screen assembly of claim 28 wherein said cleaning elements are sliders.

33. A self-cleaning system for screens used in a vibratory screen separator, comprising a flow through support surface;

cleaning elements positionable on said support surface;

a mounting fixed relative to said support surface and defining a mounting axis displaced from and substantially parallel to said support surface;

a member mounted eccentrically about said mounting axis of said mounting and displaced from said support surface to move eccentrically in response to vibration of the vibratory screen separator, said member being substantially heavier than each said cleaning element.

34. The self-cleaning system of claim 33 further comprising a plurality of said mountings and a plurality of said members associated with said mountings, respectively, said mountings being mutually spaced apart.

35. The self-cleaning system of claim 33 wherein said flow through support surface includes a screen.

36. The self-cleaning system of claim 33 wherein said cleaning elements are sliders.

* * * * *